US010321758B2

(12) United States Patent
Martinage

(10) Patent No.: US 10,321,758 B2
(45) Date of Patent: Jun. 18, 2019

(54) GUN RACK

(71) Applicant: Bernard Martinage, Fernandina Beach, FL (US)

(72) Inventor: Bernard Martinage, Fernandina Beach, FL (US)

(73) Assignee: Bernard Martinage, Fernandina Beach, FL (US)

( * ) Notice: Subject to any disclaimer, the term of this patent is extended or adjusted under 35 U.S.C. 154(b) by 0 days.

(21) Appl. No.: 15/477,102

(22) Filed: Apr. 2, 2017

(65) Prior Publication Data

US 2018/0279778 A1 Oct. 4, 2018

(51) Int. Cl.

| | |
|---|---|
| ***A47B 43/00*** | (2006.01) |
| ***A47F 7/00*** | (2006.01) |
| ***A47B 81/00*** | (2006.01) |
| *F41A 23/18* | (2006.01) |
| *F41C 33/06* | (2006.01) |

(52) U.S. Cl.
CPC ..... *A47B 81/005* (2013.01); *A47B 43/00* (2013.01); *F41A 23/18* (2013.01); *F41C 33/06* (2013.01)

(58) Field of Classification Search
CPC ..... F41C 33/06; A47B 81/005; A47B 81/00; A47B 43/00; A63B 55/10
See application file for complete search history.

(56) References Cited

U.S. PATENT DOCUMENTS 548,273 A * 10/1895 Rouse ..... B60J 3/0217 211/126.1
907,171 A * 12/1908 Knight et al. ..... A47G 25/12 211/195
1,554,211 A * 9/1925 Halevy ..... A47B 23/043 211/198
2,059,445 A * 11/1936 Eastman ..... B25H 3/04 211/182
2,454,559 A * 11/1948 Kuehn ..... D06F 57/08 211/104
3,248,027 A * 4/1966 Pfleider ..... A63C 11/025 211/70.5
3,415,572 A * 12/1968 Zagwyn ..... A47C 4/48 211/70.2
3,420,488 A * 1/1969 Sisler ..... A47B 5/04 15/265
4,526,414 A * 7/1985 Jones ..... A01K 97/06 294/143
4,666,038 A * 5/1987 Minneman ..... A63B 55/10 206/315.2
4,779,914 A * 10/1988 Friedline ..... A01K 97/10 211/198
5,226,666 A * 7/1993 Dinkens, Jr. ..... A63B 55/10 211/70.2
5,234,114 A * 8/1993 Coffey ..... A63B 55/10 206/315.2
5,346,063 A * 9/1994 Chow ..... B25H 3/04 206/376

(Continued)

*Primary Examiner* — Kimberley S Wright
(74) *Attorney, Agent, or Firm* — Jeremy Howard

(57) ABSTRACT

A rack including a main body, an arm connected to the main body so as to be disposed in an opening of the main body when in a storage position, and so as to extend from a front face of the main body when in a display position. The arm includes a base portion connected to the main body, and a gun support extending from the base portion.

18 Claims, 16 Drawing Sheets

(56) References Cited

U.S. PATENT DOCUMENTS

| | | | | | |
|---|---|---|---|---|---|
| 5,505,316 | A * | 4/1996 | Lee | B25H 3/04 | 206/376 |
| D372,144 | S * | 7/1996 | Selby | D3/315 | |
| 5,950,845 | A * | 9/1999 | Harris | A47G 25/0685 | 211/100 |
| 6,032,999 | A * | 3/2000 | York | A63B 55/10 | 211/70.2 |
| D424,141 | S * | 5/2000 | Eckmann | D21/686 | |
| 6,315,121 | B1 * | 11/2001 | Hansen | B25H 3/04 | 206/376 |
| 6,464,091 | B1 * | 10/2002 | Nagasaki | A47G 25/0685 | 211/1.3 |
| 6,607,077 | B2 * | 8/2003 | Feeney | A45F 3/14 | 206/315.2 |
| 7,134,548 | B2 * | 11/2006 | Meehan | A45C 11/00 | 206/315.1 |
| 7,185,899 | B2 * | 3/2007 | Thiede | A47B 46/00 | 211/189 |
| 7,942,747 | B2 * | 5/2011 | Cole | A47B 47/00 | 211/100 |
| 8,757,399 | B2 * | 6/2014 | Wolfbauer | A01K 97/08 | 211/60.1 |
| 2003/0047472 | A1 * | 3/2003 | Feeney | A45F 3/14 | 206/315.7 |
| 2004/0150177 | A1 * | 8/2004 | Thiede | A47B 46/00 | 280/79.3 |
| 2008/0053936 | A1 * | 3/2008 | Seehoff | A47G 25/0685 | 211/104 |
| 2013/0015151 | A1 * | 1/2013 | Wolfbauer | A01K 97/08 | 211/70.8 |

* cited by examiner

GUN RACK

BACKGROUND OF THE INVENTION

Field of the Invention

The present invention generally relates to gun racks. In particular, the invention relates to gun racks having moving elements to allow a small footprint and easy transportation when not in use.

Description of the Related Art

Current commercially available gun racks are large and bulky, have few options for display and setup, and are not easily portable.

SUMMARY OF THE INVENTION

In view of the foregoing, and other, exemplary problems, drawbacks, and disadvantages of the conventional systems, it is an exemplary aspect of the present invention to provide a gun rack which is easy to move from location to location, quick and convenient to set-up for use, and has the ability to utilized in a variety of display configurations.

It is, therefore, an exemplary feature of the present invention to provide structures and methods for easily displaying multiple guns.

Some embodiments of this novel design allow for five different display configurations, giving it a great deal of versatility to meet the many different needs of gun owners, instructors, manufacturers, and retailers.

As the design can allow the gun rack to fold flat, essentially to the footprint of the main base, the rack can easily be stored behind a door, gun safe, or other out of sight area. This same feature also allows some embodiments of the racks to be easily stackable, so that ten gun racks can easily fit into a compact car. This provides great utility for firearms instructors, retailers, and weapon manufactures which need to display a multitude of firearms at one time.

In a first exemplary aspect of the invention, to achieve the above and other features and purposes described herein, is a rack including a main body, and an arm connected to the main body so as to be disposed in an opening of the main body when in a storage position, and so as to extend from a front face of the main body when in a display position. The arm includes a base portion connected to the main body, and a gun support extending from the base portion so as to form a gun rest.

An exemplary aspect of the invention includes a leg connected to the main body so as to allow the leg to swing outward from the main body, a slot in the main body configured such that the leg, when in the closed position, fits within the slot, and a restraining member attached to the main body which limits the outward rotation of the leg.

This may allow the rack to be free standing on a flat surface while allowing the rack to be compact to allow for easy storage. Indeed, with the arms and legs able to fit into openings in the main body, the area occupied in the storage position is essentially the size of the main body.

In an exemplary aspect of the invention, the arm further includes a base portion, and a gun support, the gun support extending from the base portion in a direction away from a bottom of the base portion.

In an exemplary aspect of the invention, the gun support includes an angled gun rest which extends from the base portion at an acute angle relative to a bottom of the base portion.

In an exemplary aspect of the invention, the gun support includes a flat gun rest which extends from the base portion at an angle approximately perpendicular to a bottom of the base portion.

In an exemplary aspect of the invention, the angled gun rest is on a side of the gun support opposite the flat gun rest.

In an exemplary aspect of the invention, one side of the main body includes two securing holes on either side of a center hole, the center hole having a projection extending toward a center of the center hole.

An exemplary aspect of the invention also includes a locking device connected to the main body and configured so as to restrain rotational movement of the arm when the locking device is in an engaging position.

An exemplary aspect of the invention also includes a fastener attaching the arm to the main body so as to allow the arm to rotate relative to the main body.

In an exemplary aspect of the invention, the main body includes receiving slots in the main body at a side of the opening, and the arm includes groves in a base portion on a side of the base portion opposite the gun support, the grove being configured so as to fit into the receiving slots when the arm is in the display position.

In an exemplary aspect of the invention, an end face of the gun support includes a projection shaped so as to fit within the receiving slots to secure the arm when in the storage position.

In an exemplary aspect of the invention, the arm is disposed perpendicular to the main body when in the display position.

In an exemplary aspect of the invention, the arm is disposed parallel to the main body when in the storage position.

In an exemplary aspect of the invention, the main body includes a center portion adjacent to the opening, the center portion having grooves formed therein, and a pistol shelf having an insert portion configured to fit within the grooves, and a platform connected to the insert portion. The platform may be formed so as to be parallel with top of the main body Another exemplary aspect of the invention is a rack including a main body, and a plurality of arms connected to the main body, so as to be disposed in openings of the main body when in the storage position, and so as to be disposed perpendicular to the main body when in a display position. The plurality of arms each include a base portion connected to the main body, and a plurality of gun supports extending from the base portion so as to form gun rests.

Some aspects of the invention include a plurality of locking devices connected to the main body and configured so as to restrain rotational movement of the plurality of arms when the locking devices are in an engaging position.

In an exemplary aspect of the invention, the gun support includes an angled gun rest which extends from the base portion at an acute angle relative to a bottom of the base portion, and the gun support includes a flat gun rest which extends from the base portion at an angle approximately perpendicular to a bottom of the base portion.

Another exemplary aspect of the invention is a first rack as described above, a second rack as described above, and a connecting member connecting the first rack to the second rack.

In an exemplary aspect of the invention, the connecting member is configured so as to engage with the locking device.

In an exemplary aspect of the invention, the connecting member includes a main portion, and a head portion. In this embodiment, the bottom of the main portion tapers inward toward a length-wise center axis of the main portion then outward from the length-wise center axis so as to form a bottom groove of the head portion, and a top of the main portion tapers outward from the length-wise center axis so as to form a top groove of the head portion.

The above aspects may provide a versatile gun rack able to be easily transported and set up with minimal effort.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF EXEMPLARY EMBODIMENTS OF THE INVENTION

Figure 1:
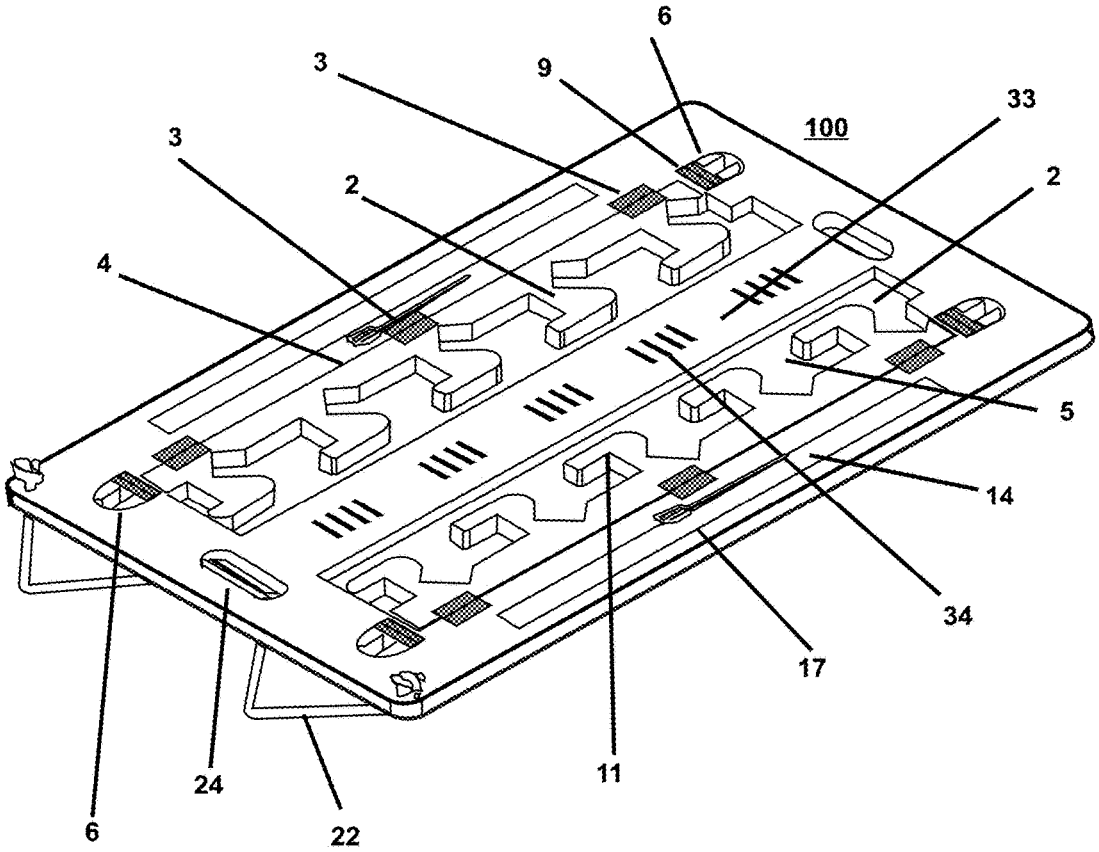
FIG. 1 illustrates a prospective view of the front of an exemplary embodiment of the gun rack with arms and legs in the closed positions.

Referring now to the drawings, and more particularly to FIGS. 1-23, there are shown exemplary embodiments of the method and structures according to the present invention.

Figure 2:
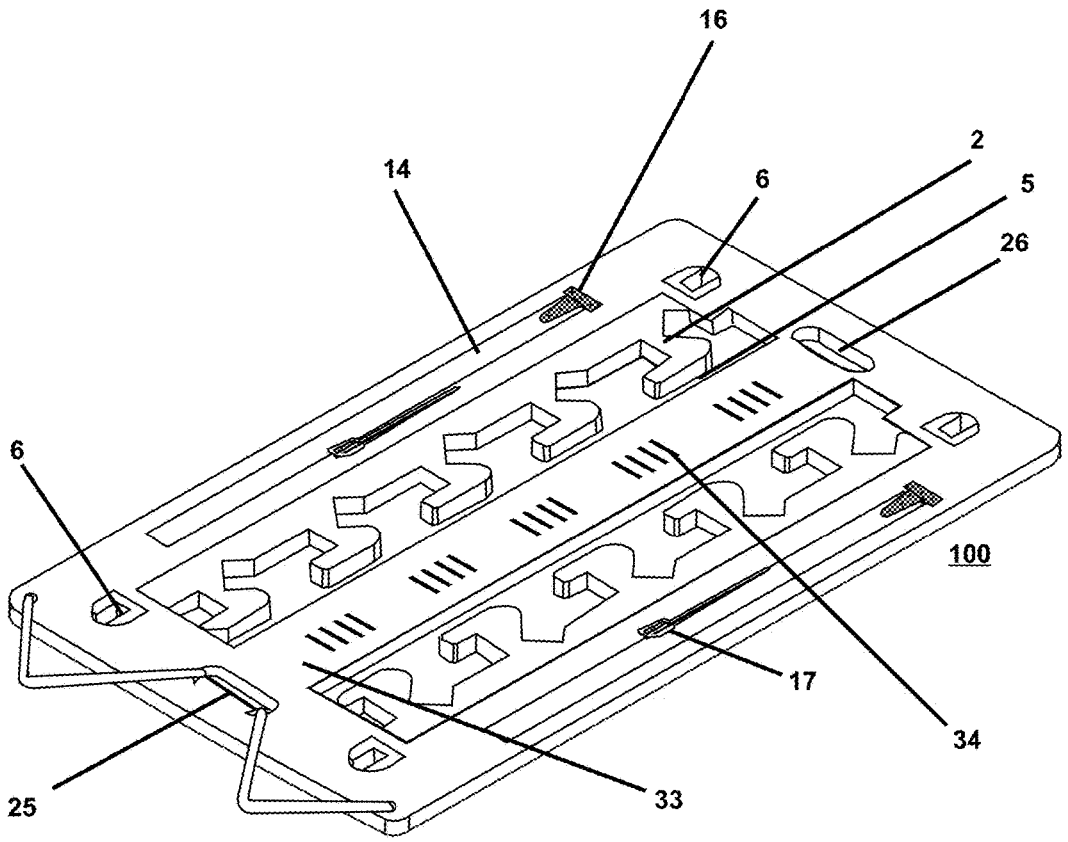
FIG. 2 illustrates a prospective view of the back of the gun rack of FIG. 1 with arms and legs in the closed positions.
Figure 6:
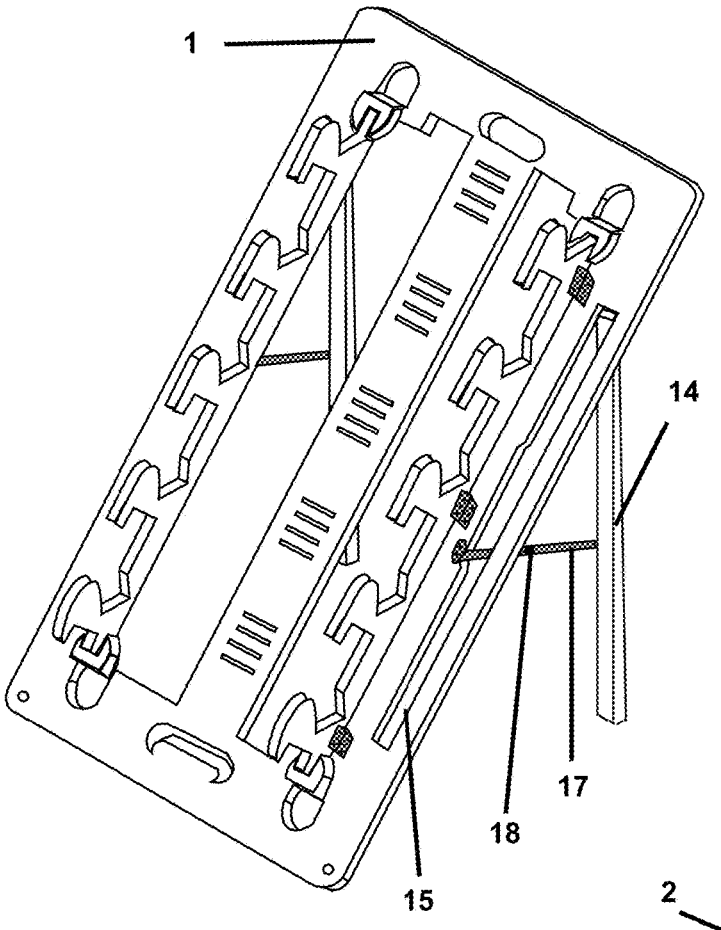
FIG. 6 illustrates a prospective view of an exemplary embodiment of the gun rack with arms and legs in the open positions.
Figure 7:
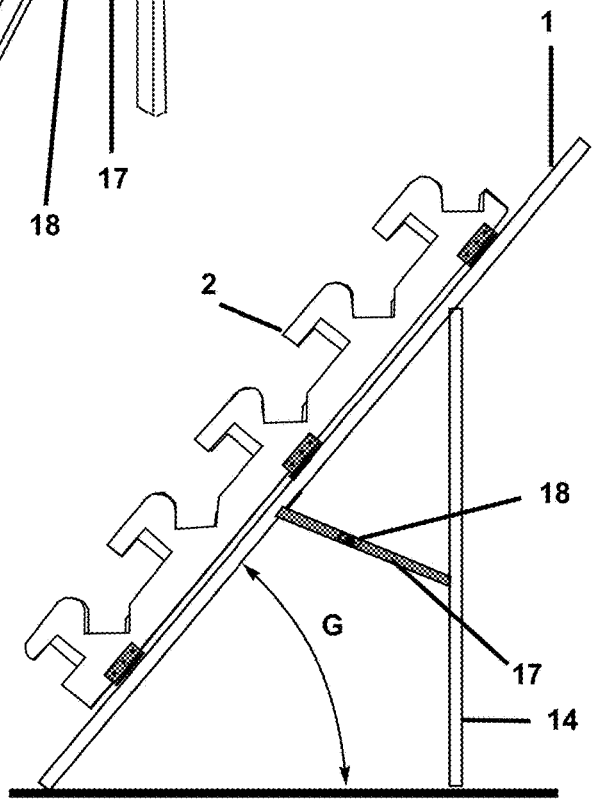
FIG. 7 illustrates a side view of the gun rack of FIG. 6 with the arms and legs in the tabletop display position.

As can be seen in FIGS. 1-16, an exemplary embodiment of the invention includes a main body 1 on to which two arms 2 are attached by fasteners 3. The fasteners 3 can be attached to base portions 4 of arms 2 and may be a hinge or any other connector which allows relative rotational movement between the arm 2 and the main body 1. As shown in FIGS. 1 and 2, when arms 2 are in the storage position, the arms 2 are housed in openings 5 of the main body 1. As shown in FIGS. 6 and 7, when arms 2 are rotated to the display position, the arms 2 are moved outside of openings 5 of main body 1. In some embodiments, arms 2 may be rotated ninety degrees from the storage position, so as to be adjacent to and perpendicular to main body 1 when in the display position. As can be seen in FIGS. 1, 2 and 6, openings 5 may extend through the entirety of main body 1, so as to form through holes. This can lead to a reduced weight for the gun rack 100.

As shown in FIG. 2, leg 14 is attached to main body 1 through the use of a fastener 16, which may be a hinge device, so as to allow leg 14 to swing outward from main body 1. Leg 14 is also attached to main body 1 by a retaining member 17, which limits the outward movement of leg 14. As can be seen in FIG. 7, retaining member 17 may include a leg locking mechanism 18 which allows the leg 14 to be locked into the tabletop setup position. Slots 15 are formed so as to allow the legs 14 and retaining member 17 to fit within slots 15 when the legs 14 are not extended (e.g., see FIGS. 1, 2 and 3A). This allows gun rack 100 to maintain a flat profile for maximum portability/stack-ability. Alternatively, in some embodiments, retaining member 17 may be a mechanism which only prevents outward movement past a certain point in the tabletop setup position, such as a cord.

Figure 3A:
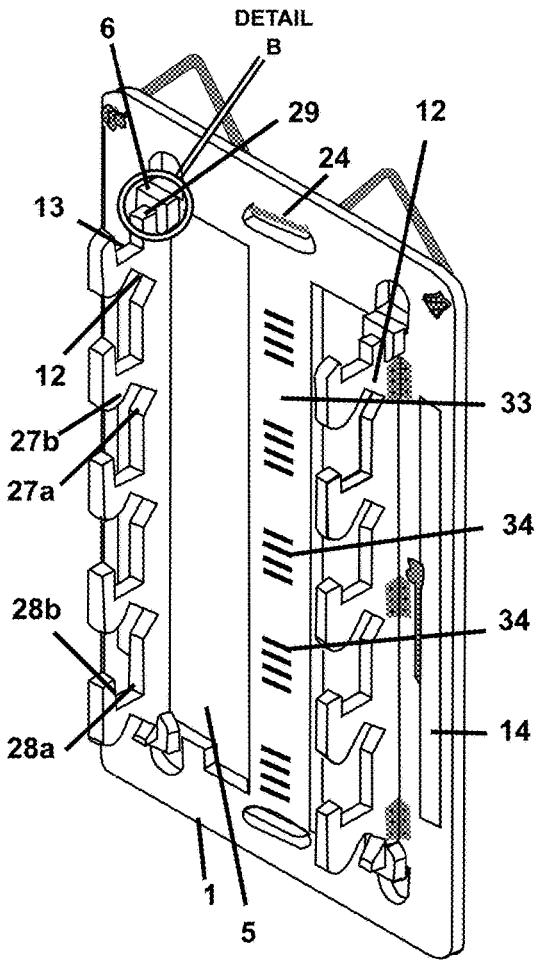
FIG. 3A illustrates a prospective view of the front of the gun rack of FIG. 1 with the arms in the display position with a close-up view of a locking device.
Figure 13A:
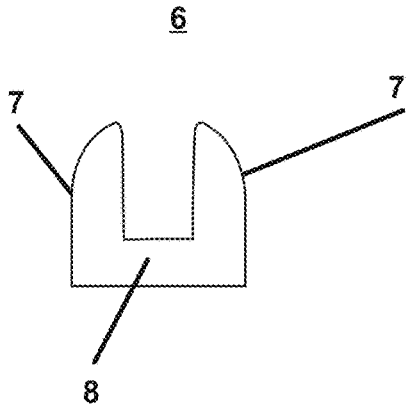
FIG. 13A illustrates a side view of an exemplary locking device.
Figure 13B:
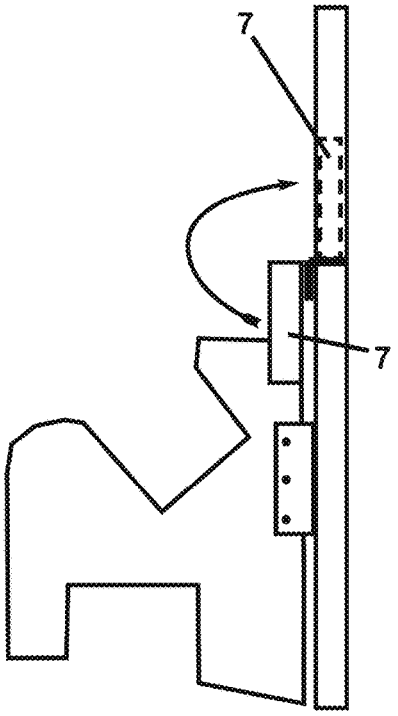
FIG. 13B illustrates a front view of an exemplary locking device connected to the main body in the open and closed position.

As shown in FIG. 3A, while the arms 2 are in the display position, locking devices 6 may be moved to the arm engaging position so as to secure arms 2 from moving rotationally toward or away from their respective openings 5. As seen in FIG. 13A, locking devices 6 may be U-shaped members having two side portions 7 extending from a center portion 8. Center portion 8 may be connected to main body 1 by a fastener 9 so as to allow locking device 6 to rotate from within cut-out 10 towards arm 2.

Figure 3B:
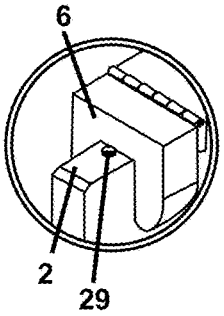
FIG. 3B illustrates Detail B of FIG. 3A.
Figure 10A:
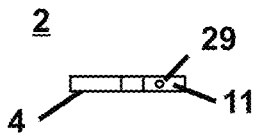
FIG. 10A illustrates a top view of an exemplary left arm.
Figure 11A:
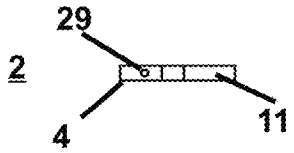
FIG. 11A illustrates a top view of an exemplary right arm.

As shown in FIGS. 3A and 6, when in the locking position, side portions 7 may be disposed on opposite sides of arms 2, to prevent rotation of arms 2. As shown in FIGS. 1 and 2, when in the closed position, locking device 6 is disposed in cut-out 10. Cut-out 10 may be a though hole in main body 1. In some embodiments, locking device 6 may be formed such that, when in the locking position, side portions 7 are held in place around locking arm 2 through friction and/or a tight/press fit so as to clamp arm 2 between side portions 7. In addition, in some embodiments as shown in FIGS. 3B, 10A and 11A, a spring plunger 29 (or other elastic member or nub) may be included in the top and/or bottom of arm 2 so as to allow the plunger to extend once the locking device 6 is in place. This can provide an additional level of securing to the locking device 6 and reduce the needed manufacturing tolerances required to hold the locking device 6 in place when holding arm 2.

Figure 8:
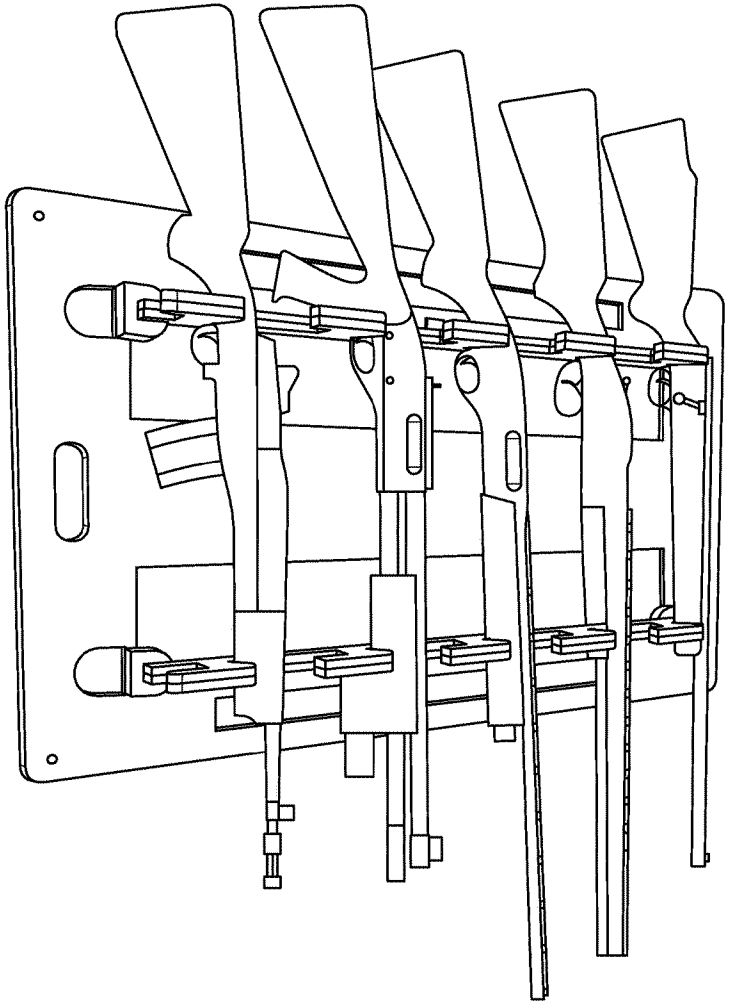
FIG. 8 shows an embodiment of the gun rack in the tabletop position holding a variety of long guns.
Figure 9:
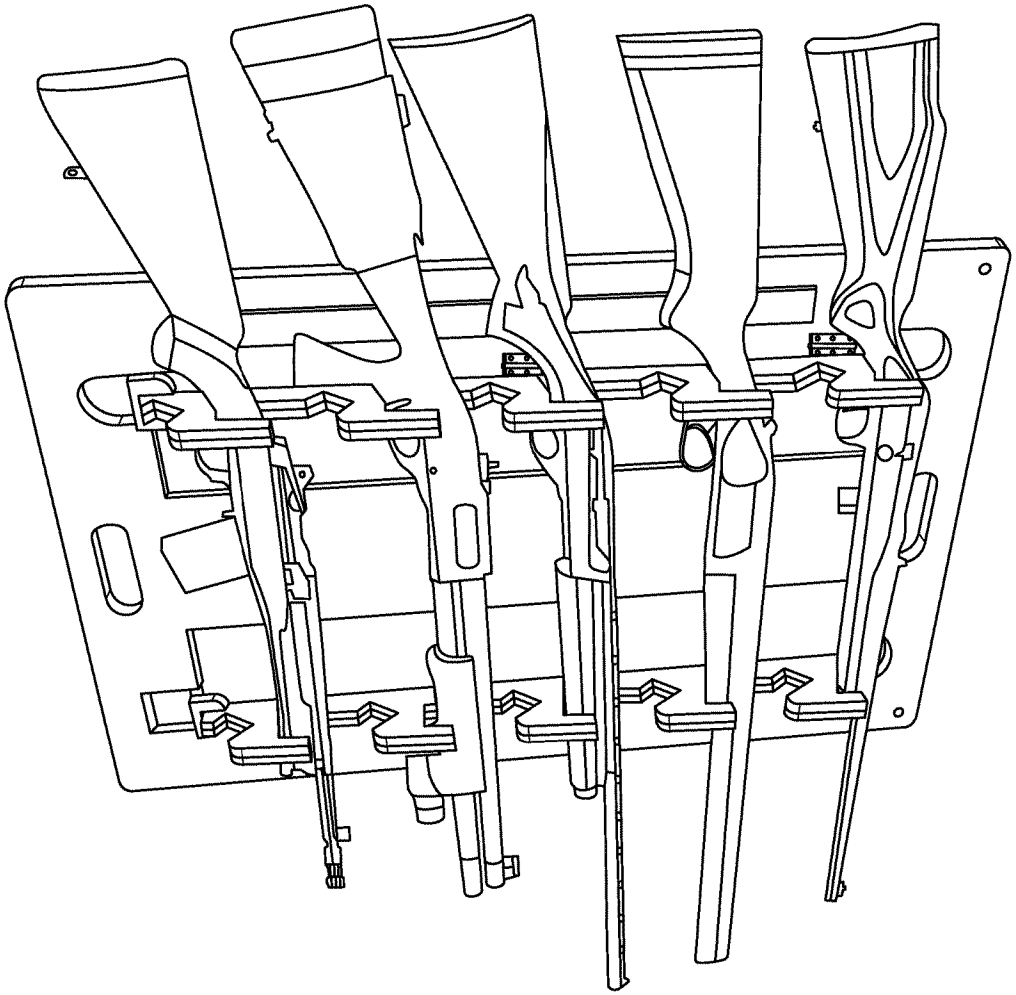
FIG. 9 shows an embodiment of the gun rack in the vertical position holding a variety of long guns.

As shown in FIGS. 1, 2, 3A, 10B and 11B, the arms 2 have a plurality of gun supports 11 which extend from the front side of base portion 4. Gun supports 11 are configured so as to hold a firearm. As shown in FIGS. 8 and 9, a long gun (e.g., shotgun, rifle, assault rifle, over-under shotgun, etc.) may be held by one gun support 11 on each arm 2.

Gun supports 11 may include an angled gun rest 12, which is angled relative to main body 1. Side walls 27*a* and 27*b* may be provided with angled gun rest 12. In some embodiments, side walls 27*a* and 27*b* extend perpendicular to angled gun rest 12.

Gun supports 11 may also include a flat gun rest 13. Side walls 28*a* and 28*b* may be provided with flat gun rest 13. In some embodiments, side walls 28*a* and 28*b* may be perpendicular to flat gun rest 13.

Figure 10B:
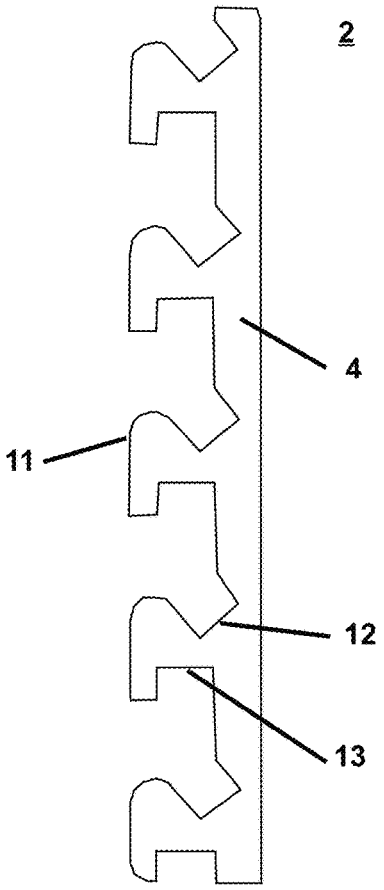
FIG. 10B illustrates a side view of an exemplary left arm.
Figure 11B:
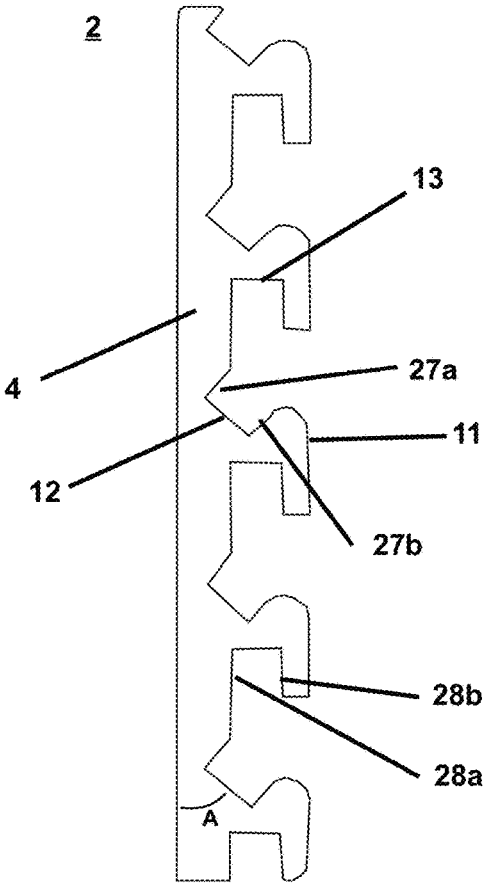
FIG. 11B illustrates a side view of an exemplary right arm.

In some embodiments, as shown in FIGS. 10B and 11B, a first portion of gun support 11 extends from the base portion 4 in a direction perpendicular to the back side base portion 4 so as to form flat gun rest 13. A second portion of gun support 11 extends from the base portion 4 in a direction angled toward to first portion of gun support 11, so as to so as to form angled gun rest 12. From the angled gun rest 12, gun support 11 then extends in a direction perpendicular from angled gun rest 12 and then curves to as to present a rounded surface to prevent unnecessary abrasion of the resting firearm. Angled gun rest 12 may be formed so as to form a notch in base portion 4. Gun support 11 then extends parallel to base portion 4, past flat gun rest 13, then perpendicular to base portion 4, then back toward flat gun rest 13 approximately parallel to base portion 4, so as to form one of side walls 28*b*.

Figure 4:
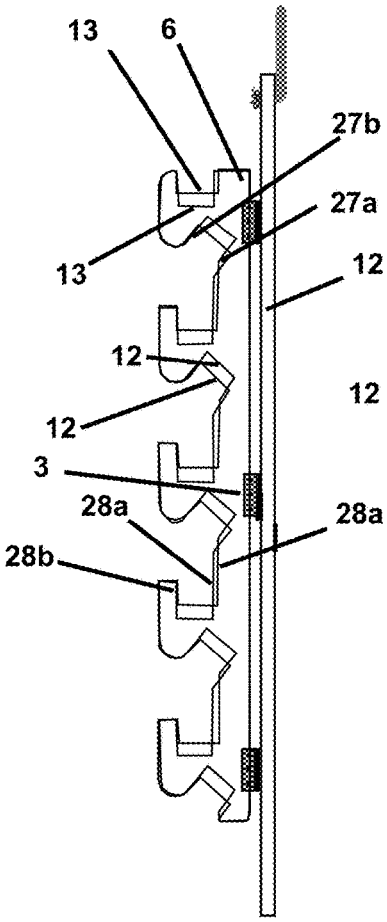
FIG. 4 illustrates a side view of the gun rack of FIG. 1 with the arms in the display position.

In some embodiments, as can be seen in FIGS. 4 and 7, the flat gun rest 13 on one of arms 2 may be offset relative to the flat gun rest 13 of the other of arms 2. This can allow the firearms to sit relatively flat in the horizontal direction while displayed. After much experimentation with various long gun types, it has been ascertained that an offset of about ⅝ of an inch provides the most consistent horizontal profile over a range of long gun types (e.g., shotguns, rifles, assault rifles, over-under shotguns, etc.) In these embodiments, the receiver is often slightly lower than the barrel, so that with the offset, the gun is displayed in a horizontal position, as shown in FIG. 9.

Similarly, as can be seen in FIGS. 4 and 7, the angled gun rest 12 on one of arms 2 may be offset relative to the angled gun rest 12 of the other of arms 2. This can allow the firearms to sit in a relatively flat in the horizontal direction while displayed. After much experimentation with various long gun types, it has been ascertained that an offset of about ⅝ of an inch provides the most consistent horizontal profile over a range of long gun types (e.g., shotguns, rifles, assault rifles, over-under shotguns, etc.) In these embodiments, the long gun will face to the right, as the receiver is often slightly lower than the barrel, so that the gun is displayed in a horizontal position, as shown in FIG. 8.

As illustrated in FIGS. 3A, 6 and 7, when an exemplary embodiment of gun rack 100 is in a tabletop display position, legs 14 may be extended from slots 15 of main body 1. The legs 14 extend outward from main body 1 such that when arms 2 are in the display position, legs 14 extend from a side of main body 1 opposite the side of main body 1 from which arms 2 extend from. Angle G can be any appropriate angle, such as between 40-60 degrees. Angle G is approximately 50 degrees as shown in FIG. 7. When in the closed position, legs 14 are disposed within slots 15.

As seen in FIGS. 10A and 10B, angled gun rest 12 may be angled approximately 40-50 degrees relative to the back side of base portion 4, as shown in angle A. This allows angled gun rest 12 to hold firearms essentially upright when gun rack 100 is in the tabletop setup position to allow for proper display and balance.

Figure 5:
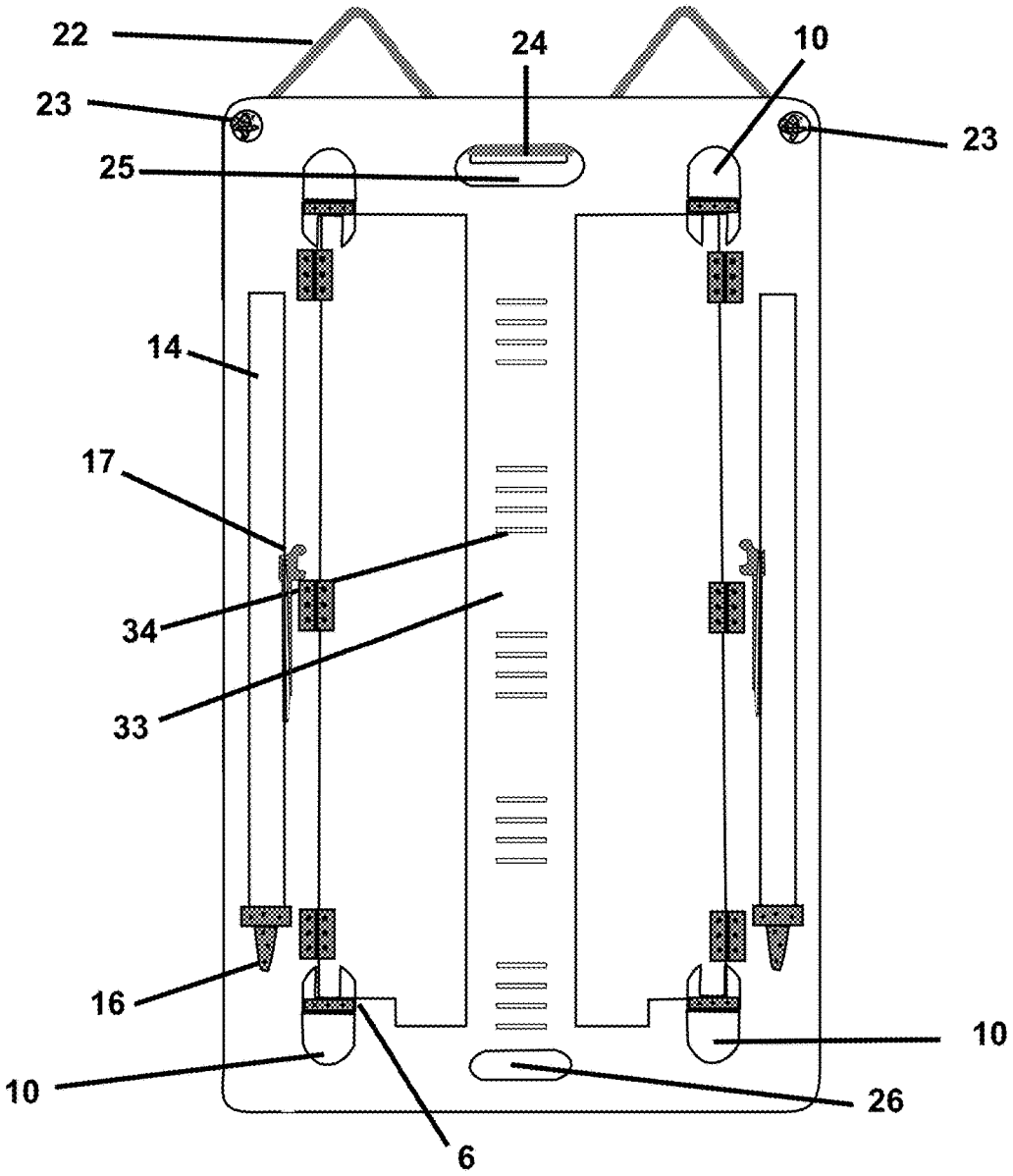
FIG. 5 illustrates a front view of the front of the gun rack of FIG. 1 with the arms omitted.

In another display position, as shown in FIGS. 3A, 4 and 5, gun rack 100 may be turned upside-down and used in a vertical position. In the vertical position, gun rack 100 is oriented so that the flat gun rest 13 faces upwards to allow firearms to be rested thereon. Gun rack 100 may be secured by a strap 22 to be hung in the vertical position. Strap 22 may be a custom made harness or a simple rope. As shown in FIGS. 3A, 4 and 5, strap 22 can be passed through holes 23 and looped over projection 24 which is formed in projection hole 25. This allows gun rack 100 to be hung from a door (e.g., a regular room door, a folding closet door, etc.) or any other structure to which strap 22 can be secured. Gun rack 100 can also be propped up against a surface in an approximately vertical position to allow the use of flat gun rests 13 without suspending the gun rack 100. In yet another option, gun rack 100 may be hung from a surface using handle 26 or projection hole 25.

Figure 12A:
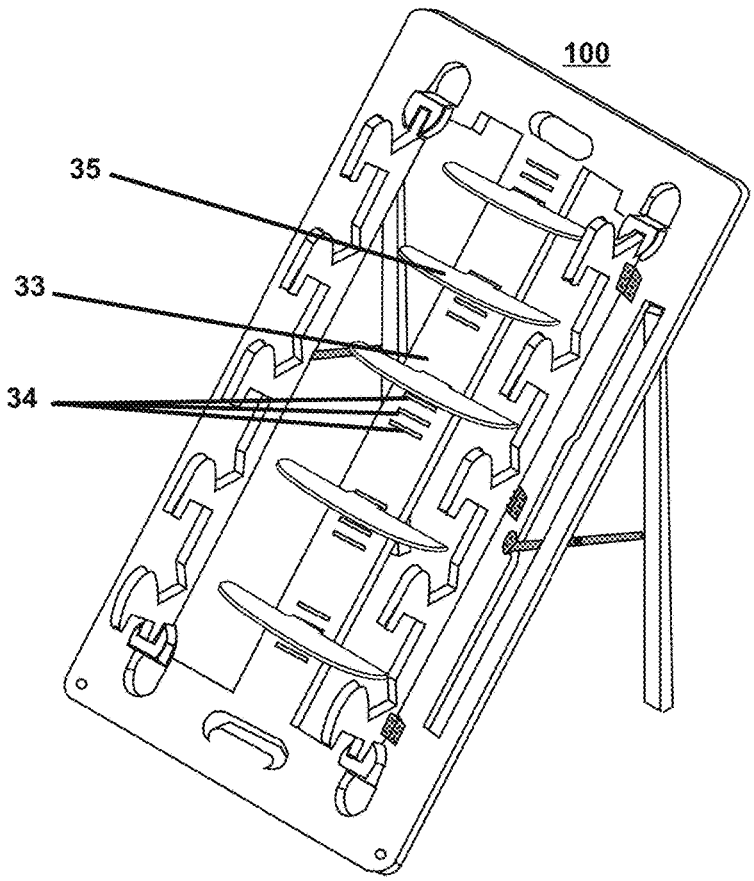
FIG. 12A illustrates an exemplary embodiment with a pistol shelf.
Figure 12B:
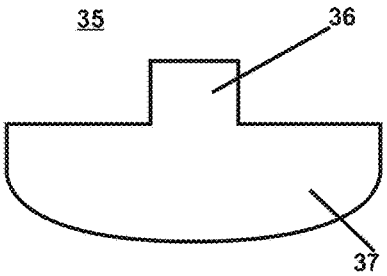
FIG. 12B illustrates a top view of an exemplary pistol shelf.
Figure 12C:
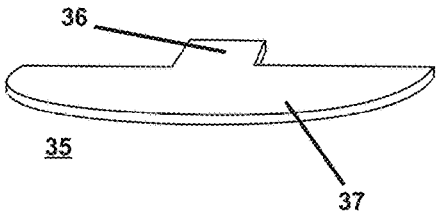
FIG. 12C illustrates a perspective view of an exemplary pistol shelf.

As shown in FIG. 12A, the main body 2 includes a center portion 33 adjacent to the opening 5, the center portion 33 having grooves 34 formed therein. A pistol shelf 35 can be inserted into a groove 34 so that a pistol can be held by pistol shelf 35 and either angled gun rest 12 or flat gun rest 13. Separate grooves 34 can be provided for flat gun rests 13 and angled gun rest 12. As shown in FIG. 12B, the pistol shelf 35 includes an insert portion 36 configured to fit within the grooves 34, and a platform 37 connected to the insert portion 36. The platform 37 is designed so as to be parallel with top of the main body 1. The butt or handle of a pistol sits on platform 37 while the barrel sits on angled gun rest 12. Two pistols can share platform 37 while using angled gun rests 12 on opposite arms 2.

Figure 14:
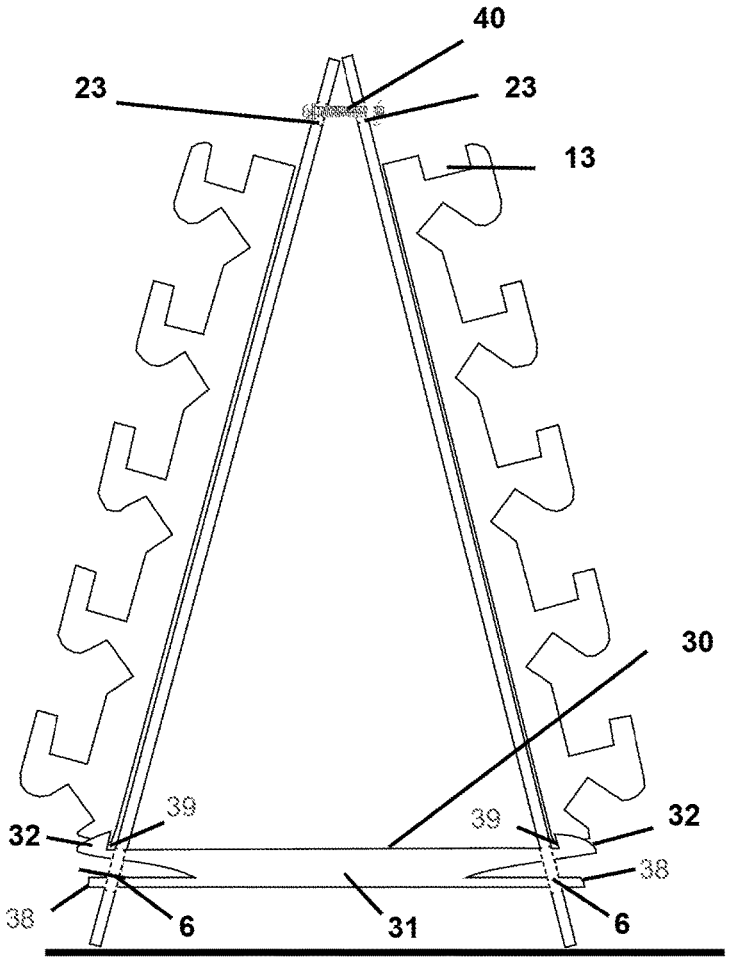
FIG. 14 illustrates a perspective view of two gun racks joined together.

As shown in FIG. 14, the tent display position involves the use of two gun racks 100 together. In this display position, the two racks 100 are positioned in an inverted V position connected to each other by a bottom connecting member 30 and a top connecting member 40. The bottom connecting member 30 connects a bottom of the first rack 100 to a bottom of the second rack 100 while the top connecting member 40 connects the top portions of the two racks.

Figure 15:
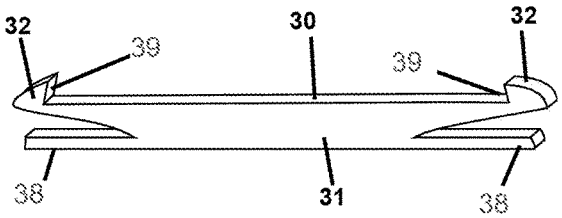
FIG. 15 illustrates an exemplary embodiment of the bottom connecting member engaged with an embodiment of the gun rack.
Figure 21:
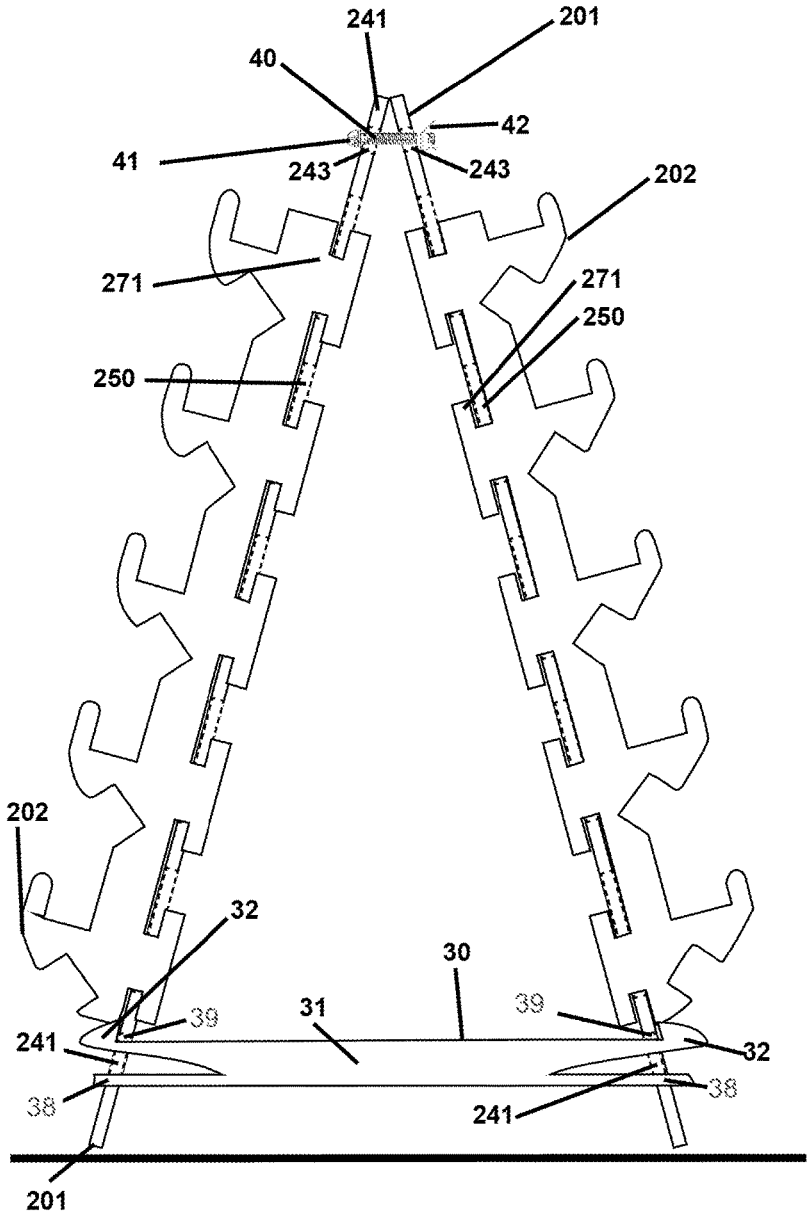
FIG. 21 illustrates an exemplary embodiment of two of the gun racks of FIG. 17 in the tent display position.

In some embodiments, as can be seen in FIGS. 14 and 15, the bottom connecting member 30 is configured so as to engage with the locking device 6. As seen in FIG. 15, the bottom connecting member 30 includes a main portion 31 and a head portion 32. A bottom of the main portion 31 tapers inward toward a length-wise axis B of the main portion 31 then outward from the length-wise axis B so as to form a bottom groove 38 of the head portion 32. A top of the main portion 31 tapers outward from the length-wise axis B so as to form a top groove 39 of the head portion 32. This shape allows the bottom connecting member 30 to lock the two gun racks 100 together at a certain distance. If desired, bottom connecting member may have multiple bottom grooves 38 and top grooves 39, so as to allow a variable angle display angle and distance between the bottoms of the two racks 100. Alternatively, as shown in FIG. 21, connecting member 30 may have a head portion 32 which elastically moves away from axis B.

Figure 16:
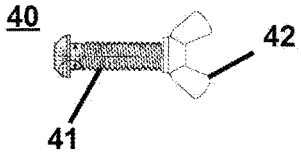
FIG. 16 illustrates an exemplary embodiment of the top connecting member.

As seen in FIG. 16, the top connecting member 40 includes a bolt 41 and a wing-nut 42. Alternatively, the top connector may be formed similarly to bottom connecting member 30 and may engage with a locking device 6 disposed on the top of the gun rack 100.

The gun rack 100 may be made of any appropriate material. For instance, main body 1, arms 2, legs 14, etc. may be made of wood, plastic, resin, acrylic, etc. Another exemplary embodiment of the invention is illustrated in FIGS. 17-23.

In this exemplary embodiment, the manner of securing arms 202 in the display and storage positions vary from those of gun rack 100. Otherwise, gun rack 200 includes similar elements, which operate in a similar manner, to those of gun rack 100.

Figure 17:
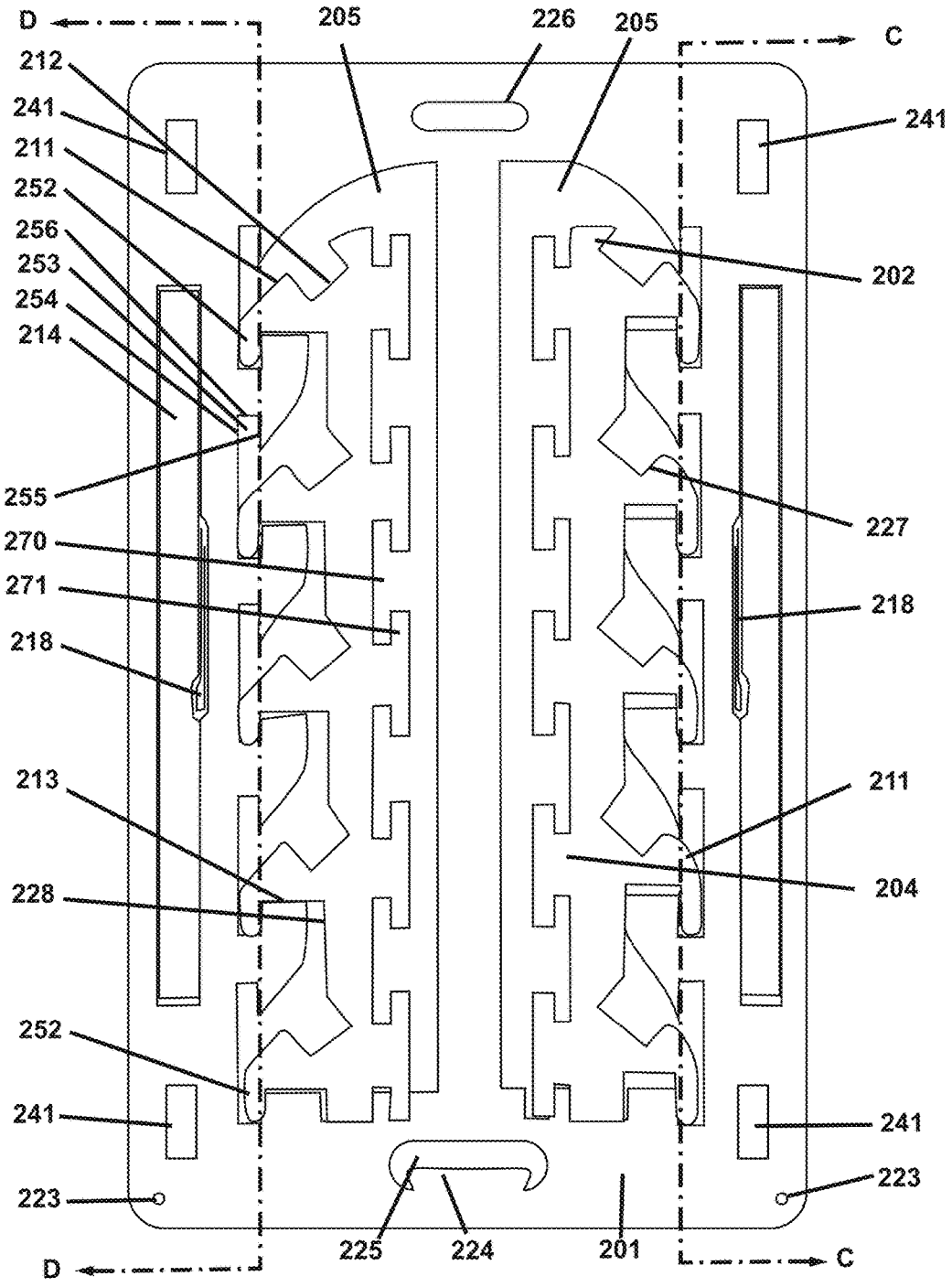
FIG. 17 illustrates another exemplary embodiment of a gun rack in the storage position.

As can be seen in FIG. 17, gun rack 200 has arms 202 which connect to main body 201 through receiving cut-outs/slots 250 formed in the main body 201 at a side of opening 205. The cut-outs 250 have an upper groove 253 with an inner side wall 254, an outer side wall 255, and a top portion 256 between the side walls. The cut-outs 250 also have a lower groove 257 with an inner side wall 258, an outer side wall 259, and a bottom portion 260 between the side walls. An end face 251 of the gun support 211 includes a projection 252 shaped so as to fit within slots 250 to secure the arm 202 when in the storage position. In particular, projection 252 can fit within the lower groove 257 to hold arm 202 in place in the storage position.

Figure 18:
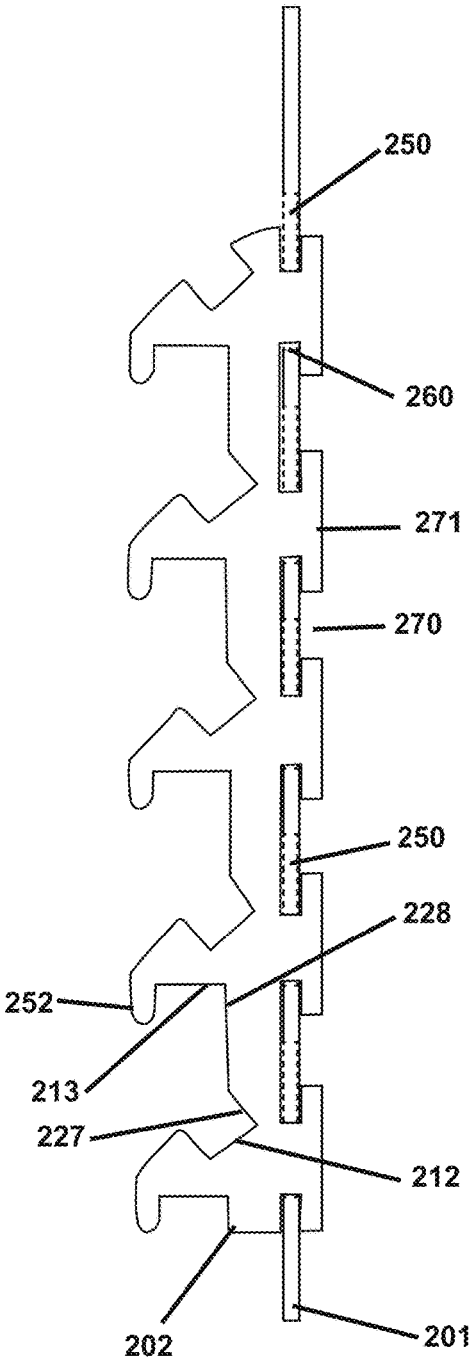
FIG. 18 illustrates an arm and the main body of the gun rack of FIG. 17 in an engaged state.
Figure 19:
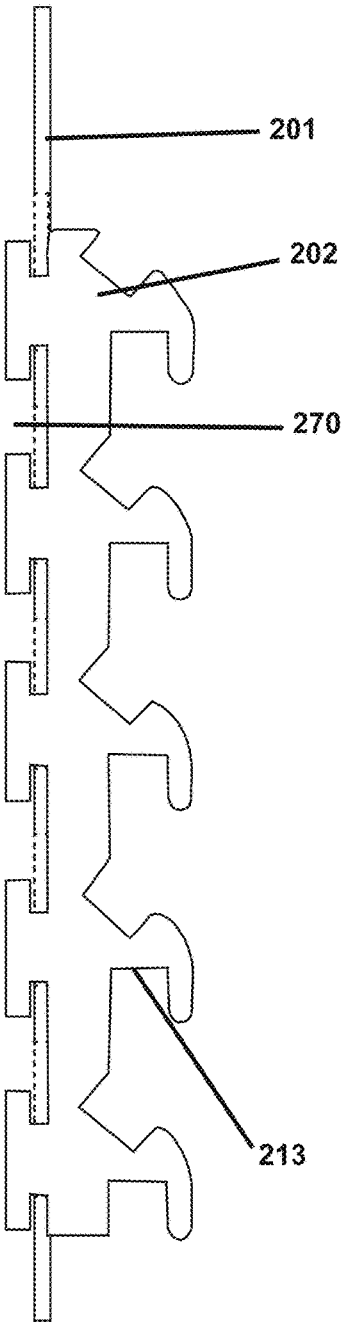
FIG. 19 illustrates a second arm and the main body of the gun rack of FIG. 17 in an engaged state.

As shown in FIGS. 17-19, arm 202 also includes T-shaped groves 270 formed in a base portion 204 of arm 202, on a side of the base portion 204 opposite the gun support 211. The groove 270 is configured so as to fit into cut-out 250 when the arm 202 is in the display position so that T-portion 271 engages with cut-out 250. When in the display position, arm 202 extends from main body 201. In some embodiments, arm 202 is disposed perpendicular to the main body 201 in the display position. When in the storage position, the arm 202 is disposed parallel to the main body 201 in opening 205. An advantage of arms 202 connecting to main body 201 through a plurality of cut-outs 250 and T-shaped grooves 270 is that the multiple connection points provide great stability to the arms 202 generally and specifically when a gun is lifted or pulled from the gun rack 200, so that no portion of arm 202 pulls away from main body 201.

Figure 20:
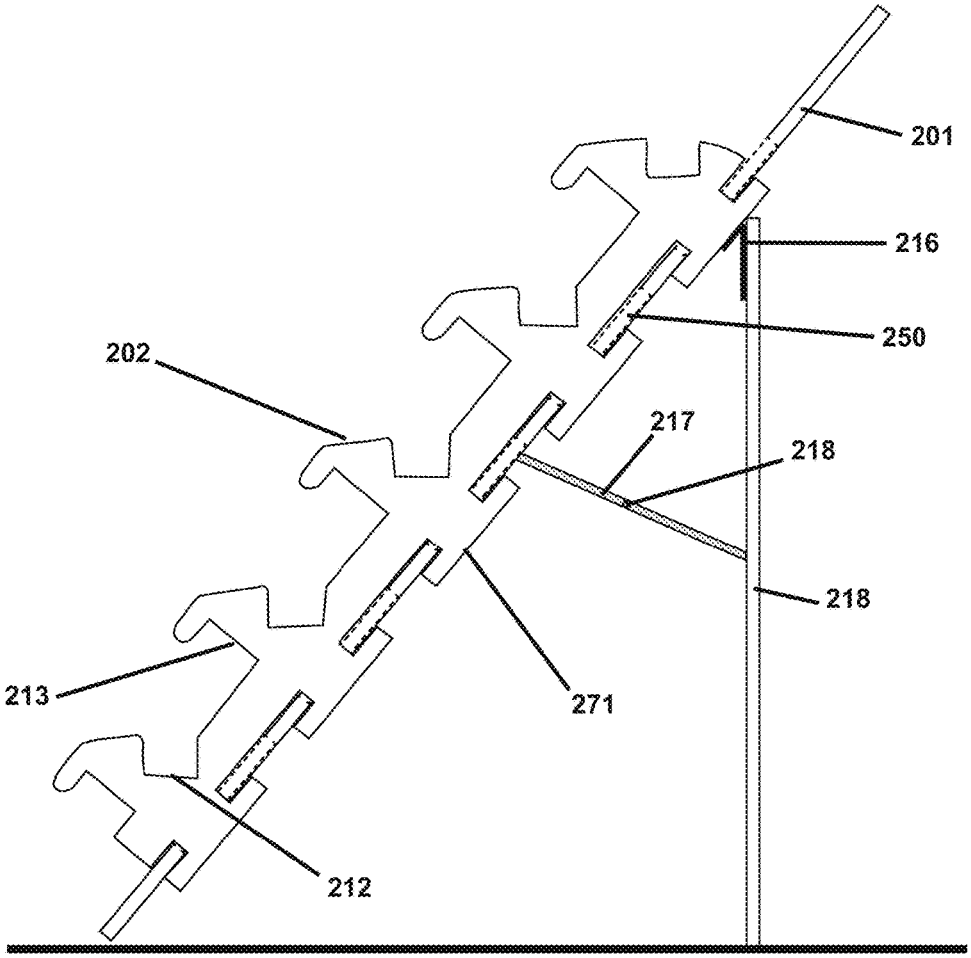
FIG. 20 illustrates a perspective view of the gun rack of FIG. 17.
Figure 23:
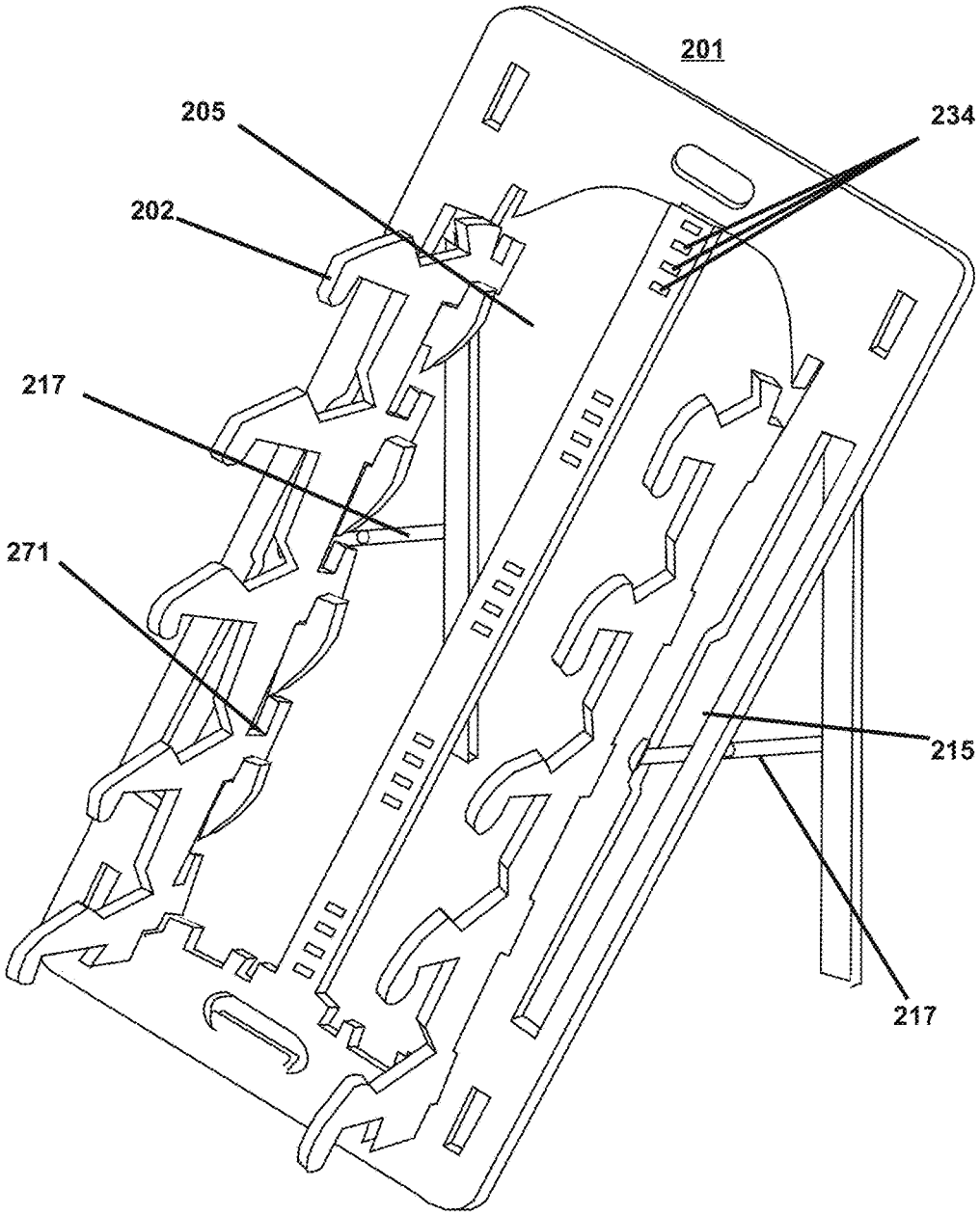
FIG. 23 illustrates exemplary embodiment of the gun rack of FIG. 17 in the table-top position.

As shown in FIGS. 20 and 23, leg 214 is attached to main body 201 through the use of a fastener 216, which may be a hinge device, so as to allow leg 214 to rotate outward from main body 201. Leg 214 is also attached to main body 201 by a retaining member 217, which limits the outward rotation of leg 214. As seen in FIG. 20, retaining member 217 may include a leg locking mechanism 218 which allows the leg 214 to be locked into the tabletop display position. Slots 215 are formed so as to allow leg locking mechanisms 218 and legs 214 to fit within slots 15 when the legs 214 are not extended. This allows gun rack 200 to maintain a flat profile for maximum portability/stack-ability.

Alternatively, in some embodiments, retaining member 217 may be a mechanism which only prevents outward movement past a certain point in the tabletop setup position, such as a cord.

The arms 202 have a plurality of gun supports 211 which extend from the front side of base portion 204. Gun supports 211 are configured so as to hold a firearm. A long gun (e.g., shotgun, rifle, assault rifle, over-under shotgun, etc.) may be held by one gun support 211 on each arm 202.

Gun supports 211 may include an angled gun rest 212, which is angled relative to main body 201. Side walls 227 may be provided with angled gun rest 212. In some embodiments, side walls 227 extend perpendicular to angled gun rest 212.

Gun supports 211 may also include a flat gun rest 213. Side walls 228 may be provided with flat gun rest 213. In some embodiments, side walls 228 may be perpendicular to flat gun rest 213.

As with gun rack 100, in some embodiments of gun rack 200, the flat gun rest 213 on one of arms 202 may be offset relative to the flat gun rest 213 of the other of arms 202. This can allow the firearms to sit in relatively flat in the horizontal direction while displayed. After much experimentation with various long gun types, it has been ascertained that an offset of about ⅝ of an inch provides the most consistent horizontal profile over a range of long gun types (e.g., shotguns, rifles, assault rifles, over-under shotguns, etc.) In these embodiments, the receiver is often slightly lower than the barrel, so that with the offset, the gun is displayed in a horizontal position.

Similarly, the angled gun rest 212 on one of arms 202 may be offset relative to the angled gun rest 212 of the other of arms 202. This can allow the firearms to sit in a relatively flat in the horizontal direction while displayed. After much experimentation with various long gun types, it has been ascertained that an offset of about ⅝ of an inch provides the most consistent horizontal profile over a range of long gun types (e.g., shotguns, rifles, assault rifles, over-under shotguns, etc.) In these embodiments, the long gun will face to the right, as the receiver is often slightly lower than the barrel, so that the gun is displayed in a horizontal position.

When gun rack 200 is in a tabletop display position, legs 214 may be extended from slots 215 of main body 201. The legs 214 extend outward from main body 1 such that when arms 202 are in the display position, legs 214 extend from a side of main body 201 opposite a side of main body 201 from which arms 202 extend. When in the closed position, legs 214 are disposed within slots 215.

Angled gun rest 212 may be angled approximately 40-50 degrees relative to a line perpendicular to the back side of base portion 204. This allows angled gun rest 212 to hold firearms essentially upright when gun rack 200 is in the tabletop setup position to allow for proper display and balance.

Figure 22:
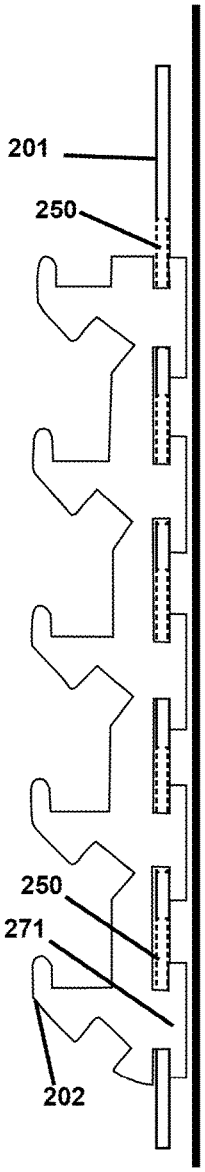
FIG. 22 illustrates exemplary embodiment of the gun rack of FIG. 17 in the hanging/vertical position.

As seen in FIG. 22, gun rack 200 may be turned upside-down and used in a vertical position. In the vertical position, gun rack 200 is oriented so that the flat gun rest 213 faces upwards to allow firearms to be rested thereon. Gun rack 200 may be secured by a strap to be hung in the vertical position. The strap or rope can be passed through holes 223 and looped over projection 224 which is formed in projection hole 225. This allows gun rack 200 to be hung from a door (e.g., a regular room door, a folding closet door, etc.) or any other structure to which a strap can be secured. Gun rack 200 can also be propped up against a surface in an approximately vertical position to allow the use of flat gun rests 213 without suspending the gun rack 200. In yet another option, gun rack 200 may be hung from a surface using handles 226 or projection hole 225.

The main body 202 includes a center portion 233 adjacent to the opening 205, the center portion 233 having grooves 234 formed therein. A pistol shelf 35 can be inserted into a groove 234 so that a pistol can be held by pistol shelf 35 and either angled gun rest 212 or flat gun rest 213. Separate grooves 234 can be provided for flat gun rests 213 and angled gun rest 212. The pistol shelf 35 includes an insert portion 36 configured to fit within the grooves 234, and a platform 37 connected to the insert portion 36. The platform 37 is designed so as to be parallel with top of the main body 201. The butt or handle of a pistol sits on platform 37 while the barrel sits on angled gun rest 212. Two pistols can share platform 37 while using opposite angled gun rest 212.

Like gun rack 100, two gun racks 200 may be positioned in an inverted V position, connected to each other by a bottom connecting member 30 and a top connecting member 40. As seen in FIG. 21, the bottom connecting member 30 connects a bottom of the first rack 200 to a bottom of the second rack 200 while the top connecting member 40 connects the top portions of the two racks. In some embodiments, the bottom connecting member(s) 30 and/or the top connecting member(s) 40 are configured so as to engage with the connecting holes 241 and through holes 223.

Similar to gun rack 100, gun rack 200 may be made of any appropriate material. In some embodiments of gun rack 200, the main body 201 and arms 202 may be formed of a somewhat flexible material, such as a plastic or resin, to allow the projection 252 to be secured to slot 250 to keep arm 202 in place when in the storage/closed position. As seen in FIG. 17, additional grooves may also be provided in to top or bottom sides of opening 205 so as to engage with arms 202.

While the invention has been described with respect to guns, the rack can be used to display any appropriate item of similar shape or would fit within the portable rack.

While the invention has been described in terms of exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

The invention claimed is:

1. A rack comprising:

a main body; and an arm connected to the main body so as to be disposed in an opening of the main body when in a storage position, and so as to extend from a front face of the main body when in a display position; the arm including:

a base portion connected to the main body; and a gun support extending from the base portion, wherein, in the storage position, the base portion is connected to the main body at a connection point such that the arm extends away from the connection point of the main body in a horizontal direction further comprising a locking device connected to the main body and configured so as to restrain rotational movement of the arm when the locking device is in an engaging position, and wherein the locking device comprises:

a U-shaped member; and a hinge connected to the U-shaped member and the main body so as to allow the U-shaped member to rotated from within a recess of the main body while in the storage position and to extend outward from the main body while in the engaging position, and wherein the U-shaped member is configured such that the arm is disposed between two sidewalls of the U-shaped member while the arm is in the display position and the U-shaped member is in the engaging position.

2. The rack according to claim 1, further comprising:

a leg connected to the main body so as to allow the leg to swing outward from the main body;

a slot in the main body configured such that the leg, when in the closed position, fits within the slot; and a restraining member attached to the main body which limits the outward rotation of the leg.

3. The rack according to claim 1, wherein the gun support extends from the base portion in a direction away from a bottom of the base portion.

4. The rack according to claim 3, wherein the gun support includes an angled gun rest which extends from the base portion at an acute angle relative to a bottom of the base portion.

5. The rack according to claim 4, wherein the gun support includes a flat gun rest which extends from the base portion at an angle approximately perpendicular to a bottom of the base portion.

6. The rack according to claim 5, wherein the angled gun rest is on a side of the gun support opposite the flat gun rest.

7. The rack according to claim 1, wherein one side of the main body includes two securing holes on either side of a projection hole, the projection hole having a projection extending toward a center of the projection hole.

8. The rack according to claim 1, further comprising a fastener attaching the arm to the main body so as to allow the arm to rotate relative to the main body.

9. The rack according to claim 1, wherein the main body includes receiving slots in the main body at a side of the opening, and wherein the arm includes groves in a base portion on a side of the base portion opposite the gun support, the grove being configured so as to fit into slots when the arm is in the display position.

10. The rack according to claim 9, wherein an end face of the gun support includes a projection shaped so as to fit within the receiving slots to secure the arm when in the storage position.

11. The rack according to claim 1, wherein the arm is disposed perpendicular to the main body when in the display position.

12. The rack according to claim 11, wherein the arm is disposed parallel to the main body when in the storage position.

13. The rack according to claim 1, wherein the main body includes a center portion adjacent to the opening, the center portion having grooves formed therein; and a pistol shelf including:

an insert portion configured to fit within the grooves; and a platform connected to the insert portion, the platform formed so as to be parallel with top of the main body.

14. A rack system comprising:

a first rack according to claim 1;

a second rack according to claim 1; and a connecting member connecting the first rack to the second rack.

15. The rack system according to claim 14, further comprising a locking device connected to the main body and configured so as to restrain rotational movement of the arm when the locking device is in an engaging position, wherein the connecting member is configured so as to engage with the locking device.

16. The rack system according to claim 14, wherein the connecting member includes:

a main portion; and a head portion, wherein a bottom of the main portion tapers inward toward a length-wise axis of the main portion then outward from the length-wise axis so as to form a bottom groove of the head portion, and a top of the main portion tapers outward from the length-wise axis so as to form a top groove of the head portion.

17. The rack system according to claim 1, wherein the arm includes a plurality of the gun support extending from the base portion, the gun supports being spaced along the base portion in a vertical direction of the main body.

18. A rack comprising:

a main body; and an arm connected to the main body so as to be disposed in an opening of the main body when in a storage position, and so as to extend from a front face of the main body when in a display position; the arm including:

a base portion connected to the main body; and a gun support extending from the base portion, wherein the gun support includes an angled gun rest which extends from the base portion at an acute angle relative to a bottom of the base portion, wherein the gun support includes a flat gun rest which extends from the base portion at an angle approximately perpendicular to a bottom of the base portion, and wherein the angled gun rest is on a side of the gun support opposite the flat gun rest further comprising a locking device connected to the main body and configured so as to restrain rotational movement of the arm when the locking device is in an engaging position, and wherein the locking device comprises:

a U-shaped member; and a hinge connected to the U-shaped member and the main body so as to allow the U-shaped member to rotated from within a recess of the main body while in the storage position and to extend outward from the main body while in the engaging position, and wherein the U-shaped member is configured such that the arm is disposed between two sidewalls of the U-shaped member while the arm is in the display position and the U-shaped member is in the engaging position.

* * * * *